US011098545B2

(12) United States Patent
Fanini et al.

(10) Patent No.: US 11,098,545 B2
(45) Date of Patent: Aug. 24, 2021

(54) METHOD OF CONFIGURING SUBTERRANEAN COMPONENTS

(71) Applicants: Otto Fanini, Houston, TX (US); Michael H. Johnson, Katy, TX (US)

(72) Inventors: Otto Fanini, Houston, TX (US); Michael H. Johnson, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 97 days.

(21) Appl. No.: 16/291,765

(22) Filed: Mar. 4, 2019

(65) Prior Publication Data

US 2020/0284111 A1 Sep. 10, 2020

(51) Int. Cl.

| | |
|---|---|
| ***E21B 23/00*** | (2006.01) |
| ***E21B 47/09*** | (2012.01) |
| ***E21B 23/14*** | (2006.01) |
| ***E21B 47/00*** | (2012.01) |
| ***E21B 43/08*** | (2006.01) |
| *E21B 37/02* | (2006.01) |
| *E21B 17/02* | (2006.01) |

(52) U.S. Cl.

CPC ..... *E21B 23/14* (2013.01); *E21B 43/08* (2013.01); *E21B 47/00* (2013.01); *E21B 47/09* (2013.01); *E21B 17/028* (2013.01); *E21B 23/001* (2020.05); *E21B 37/02* (2013.01)

(58) Field of Classification Search

CPC ..... E21B 23/001; E21B 47/09

USPC ..... 104/138.1, 138.2

See application file for complete search history.

(56) References Cited

U.S. PATENT DOCUMENTS

| | | | | |
|---|---|---|---|---|
| 5,964,249 | A | 10/1999 | Kiest, Jr. | |
| 6,698,517 | B2 * | 3/2004 | Simpson | E21B 43/084 166/277 |
| 6,799,633 | B2 * | 10/2004 | McGregor | G01V 11/002 166/250.01 |
| 7,143,843 | B2 * | 12/2006 | Doering | E21B 23/14 175/24 |
| 7,325,606 | B1 * | 2/2008 | Vail, III | E21B 43/128 166/250.15 |
| 7,537,061 | B2 | 5/2009 | Hall et al. | |
| 8,258,975 | B2 * | 9/2012 | Tinnen | E21B 47/18 340/853.6 |
| 8,608,410 | B2 | 12/2013 | Shreider et al. | |
| 9,133,671 | B2 * | 9/2015 | Kellner | E21B 23/08 |
| 9,359,844 | B2 | 6/2016 | Hallundbaek | |
| 9,476,274 | B2 | 10/2016 | Edmonstone | |
| 9,791,587 | B2 * | 10/2017 | Dyer | E21B 47/13 |
| 10,612,369 | B2 * | 4/2020 | Dufour | E21B 43/12 |
| 2003/0070806 | A1 | 4/2003 | Connell et al. | |
| 2005/0006106 | A1 | 1/2005 | Hirth et al. | |
| 2005/0217861 | A1 * | 10/2005 | Misselbrook | E21B 37/00 166/373 |

(Continued)

*Primary Examiner* — Kenneth L Thompson

(74) *Attorney, Agent, or Firm* — Cantor Colburn LLP

(57) ABSTRACT

A method for configuring a wellbore system includes guiding a tractor into a tubular string including an inner surface supporting more or more components to a select one of the plurality of components, deploying an element from the tractor into the tubular string, engaging the selected one of the plurality of components with the tractor, and changing a configuration of the selected one of the plurality of components with the element deployed from the tractor.

14 Claims, 6 Drawing Sheets

(56) References Cited

U.S. PATENT DOCUMENTS

| | | | | |
|---|---|---|---|---|
| 2009/0271117 | A1* | 10/2009 | Ayoub | G01V 11/002 702/11 |
| 2011/0024188 | A1 | 2/2011 | Wassell et al. | |
| 2012/0211229 | A1 | 8/2012 | Fielder et al. | |
| 2015/0129203 | A1* | 5/2015 | Deutch | E21B 43/11 166/250.1 |
| 2015/0345250 | A1 | 12/2015 | Murphree et al. | |
| 2015/0377013 | A1 | 12/2015 | Lerner et al. | |
| 2018/0112489 | A1* | 4/2018 | Potts | E21B 33/1293 |
| 2018/0156008 | A1* | 6/2018 | Arsalan | E21B 34/06 |
| 2019/0257177 | A1* | 8/2019 | Greci | E21B 29/005 |

* cited by examiner

METHOD OF CONFIGURING SUBTERRANEAN COMPONENTS

BACKGROUND

In the resources exploration and recovery industry, various devices are positioned in a wellbore. The various devices may be associated with a tubular and could be employed to control fluid flow, sense formation and/or formation fluid parameters, filter formation fluids and the like. Typically, devices such as inflow control devices, sensors, screens and the like are incorporated into a tubular and run downhole with a downhole string. Occasionally, one or more of the devices may cease to operate or it may become desirable to add a device to the downhole string. For example, if a determination is made that a particular zone is unexpectedly producing fluid, it may become desirable to add an ICD to the downhole string.

Repairing a device and/or adding a device to a downhole system typically requires the removal of the downhole string from a formation. Once repairs and/or additions are complete, the downhole string is re-run into the formation. Removing and reinstalling a downhole string is a time consuming and costly operation. A well may be offline for a week or more during the process. Therefore, the art would be receptive to systems and methods of adding and/or adjusting downhole devices without the need to remove the downhole string.

SUMMARY

Disclosed is a method for configuring a wellbore system including guiding a tractor into a tubular string including an inner surface supporting more or more components to a select one of the plurality of components, deploying an element from the tractor into the tubular string, engaging the selected one of the plurality of components with the tractor, and changing a configuration of the selected one of the plurality of components with the element deployed from the tractor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
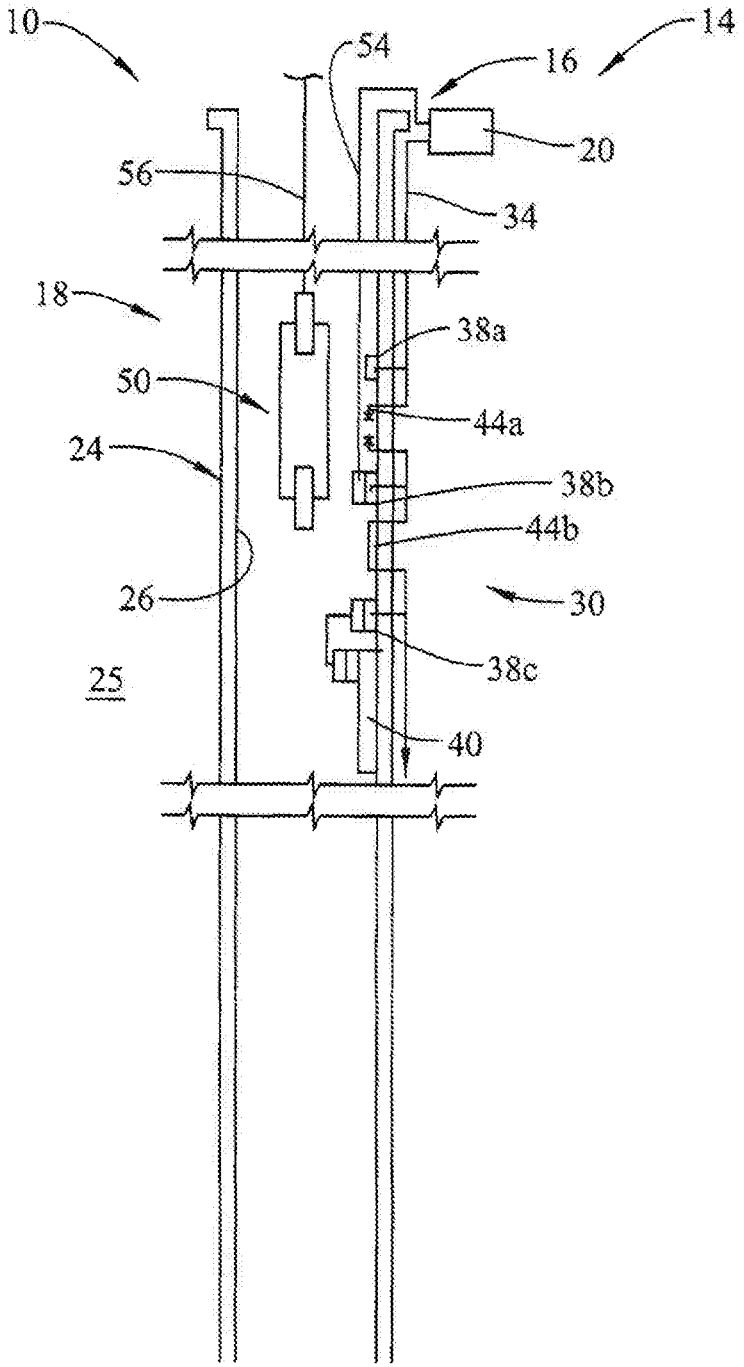
FIG. 1 depicts a resource exploration and recovery system including a system for configuring subterranean components, in accordance with an aspect of an exemplary embodiment.

A resource exploration and recovery system is indicated generally at 10 in FIG. 1. Resource exploration and recovery system 10 includes a first system 14 that may define a surface system 16. First system 14 is connected to a second system 18, which may define a subterranean system (not separately labeled). First system 14 includes a control system 20 that may be used to selectively control one or more components in second system 18. Control system, 20 may also be used to configure and/or reconfigure subterranean components as will be detailed herein.

Second system 18 includes a tubular string 24 that extends into wellbore (not separately labeled) formed in a formation 25. Tubular string 24 includes an inner surface 26 that supports a number of connector systems, one of which is indicated at 30. The number and position of connector systems may vary. A cable 34 extends from control system 20 to each connector system 30. Cable 34 may take the form of an electrical conductor, an optical conductor, a hydraulic conductor or combinations thereof.

Figure 2:
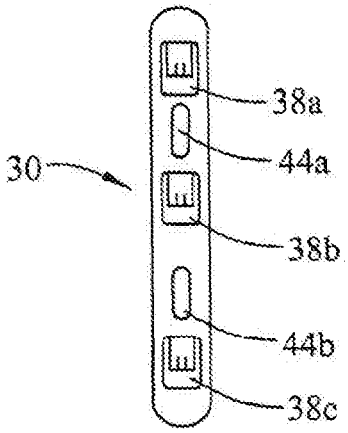
FIG. 2 depicts a connector system of the resource exploration and recovery system of FIG. 1, in accordance with an aspect of an exemplary embodiment.

Referring to FIG. 2 and with continued reference to FIG. 1, each connector system 30 includes one or more connector components identified as 38*a*-38*c*. Each connector component 38*a*-38*c* serves as a connection point for components, one of which is indicated at 40, that is installed in tubular string 24 and connected to connector component 38*c*. The components may take on various forms including sensors, actuators, communication devices, monitoring devices, valves, screens and the like as will be detailed herein. In addition to connector components 38*a*-38*c*, connector system 30 also includes frangible link components 44*a*-44*b*.

Frangible link components 44*a* and 44*b* may be selectively engaged to sever a connection between control system 20 and one or more of connector components 38*a*-38*c* in cable 34. For example, in the event of a failure in connector component 38*a* frangible link component 44*a* may be severed to allow communication to be restored to connector components 38*b* and 38*c* as will be detailed herein.

In an embodiment, an operator may introduce a tractor 50 (FIG. 1) into tubular string 24. Tractor 50 may be operated to carry an element, such as a replacement cable 54 down to connector system 30. Tractor 50 may be connected to control system 20 through a control cable 56. Of course, it should be understood that control cable 56 may link tractor 5C) to a separate controller (not shown). Control cable 56 includes a plug member 60 (FIG. 3) that may be connected to a selected one of connector components 38*a*-38*c* as will be detailed herein.

In an embodiment, in the event a failure is detected at, for example, connector system 30, tractor 50 may be directed into tubular string 24 and commanded to a selected connector component 38*a*-38*h* and frangible link components 44*a* and 44*b*. For example, tractor 50 may be directed to sever one of frangible link components 44*a*, 44*h* to ensure that no stray signals may pass through connector system 30 back to control system 20. At this point, tractor 50 may be manipulated to connect plug member 60 to a select one of connector components 38*a*-38*c*.

Figure 3:
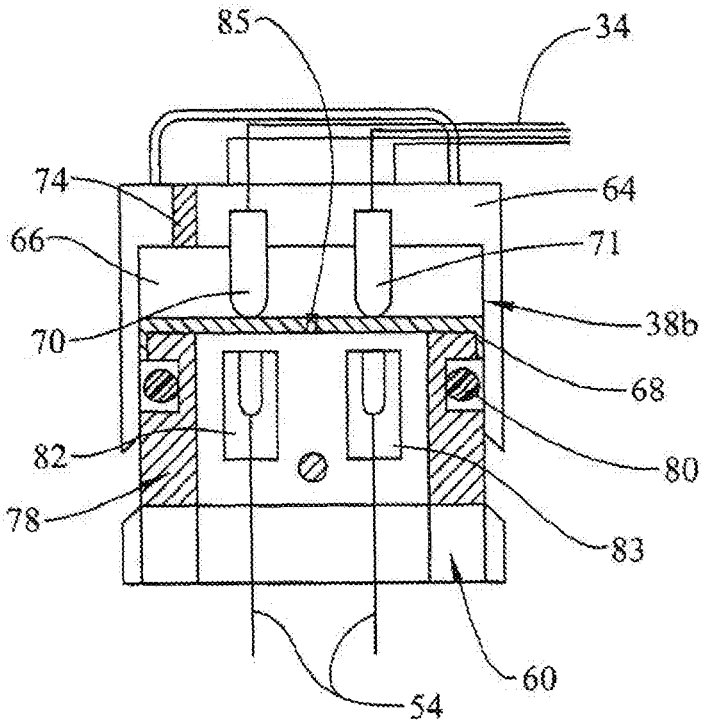
FIG. 3 depicts a connector component of the connector system of FIG. 2, in accordance with an aspect of an exemplary embodiment.

Reference will now follow to FIG. 3 in describing connector component 38*h* with an understanding that connector components 38*a* and 38*c* may include similar structure. Connector component 38*b* defines a wet connector and includes a connector component body 64 including an interior 66 that is receptive of plug member 60. A barrier member 68 extends across connector component body 64 within interior 66. Barrier member 68 shields a first connector member 70 and a second connector member 71 from downhole fluids.

Connector component body 64 also includes a vent port 74 that provides a pressure relief when plug member 60 shifts barrier member 68 as will be discussed herein. That is, during connection, plug member 60 shifts barrier member 68 inwardly. First and second connector members 70 and 71 pierce barrier member 68 and connect with plug member 60. As barrier member 68 shifts inwardly, fluid, such as air, gas, or the like, may escape connector component body 64 via vent port 74.

In an embodiment, plug member 60 includes a plug body 78 having an external seal 80 that may take the form of an O-ring (not separately labeled). Seal 80 prevents downhole fluids from reaching first and second connector member 70 and 71 when plug member 60 is connected with connector component 38*b*. Plug member 60 includes a first connector receiving portion 82 that may couple with first connector member 70 and a second connector receiving portion 83 that may couple with second connector member 71. Plug member 60 may also include an alignment element or locator 85 that registers with a recess in barrier member 68 to establish a desired alignment between first and second connector members 70 and 71 and first and second connector receiving portions 82 and 83.

Figure 4:
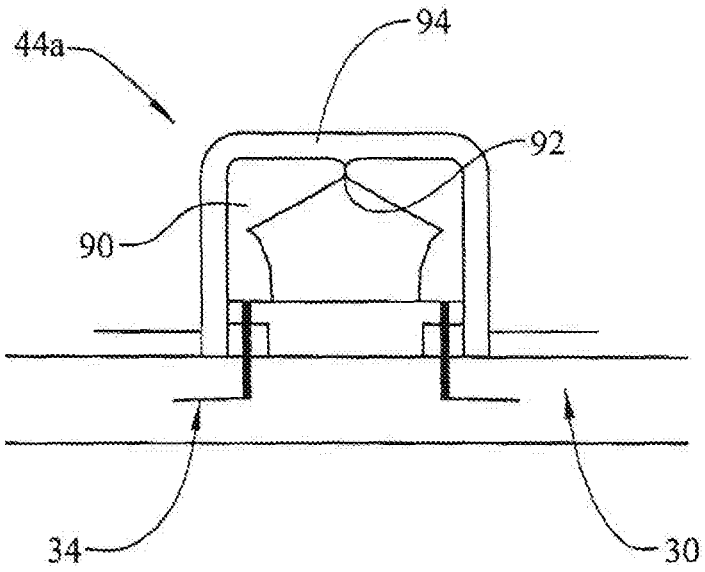
FIG. 4 depicts a frangible link component of the connector system of FIG. 2 shown in a conducting configuration, in accordance with an aspect of an exemplary embodiment.
Figure 5:
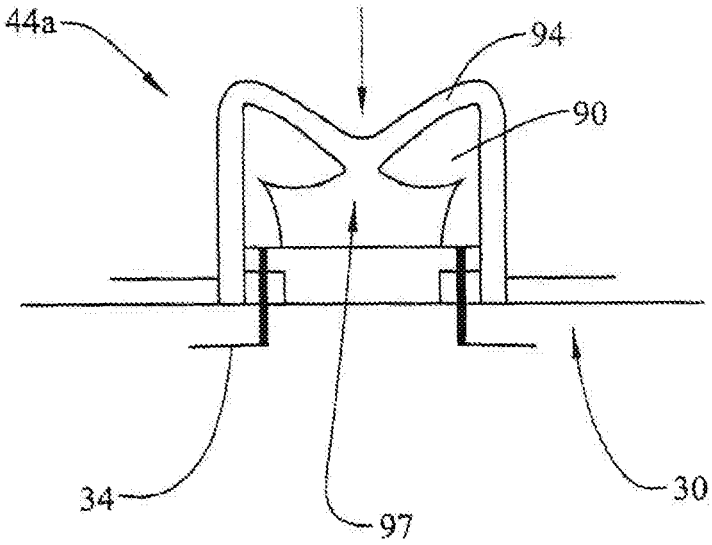
FIG. 5 depicts the frangible link component of FIG. 4 shown in a non-conducting configuration, in accordance with an aspect of an exemplary embodiment.

Reference will now follow to FIGS. 4 and 5 in describing frangible link component 44*a* with an understanding that frangible link component 44*b* may include similar structure. Frangible link component 44*a* includes a conductor merriber 90 having a frangible joint section 92. A cover member 94 encapsulates conductor member 90. In the event a failure is detected in a connector system and or cable 34, tractor 50 may be dispatched to act upon conductor member 90 causing frangible joint section 92 to disconnect creating a break or interruption 97. In this manner, operators ensure that no stray signals may pass through cable 34 back to control system 20 or into replacement cable 54 once plug 60 is installed.

Figure 6:
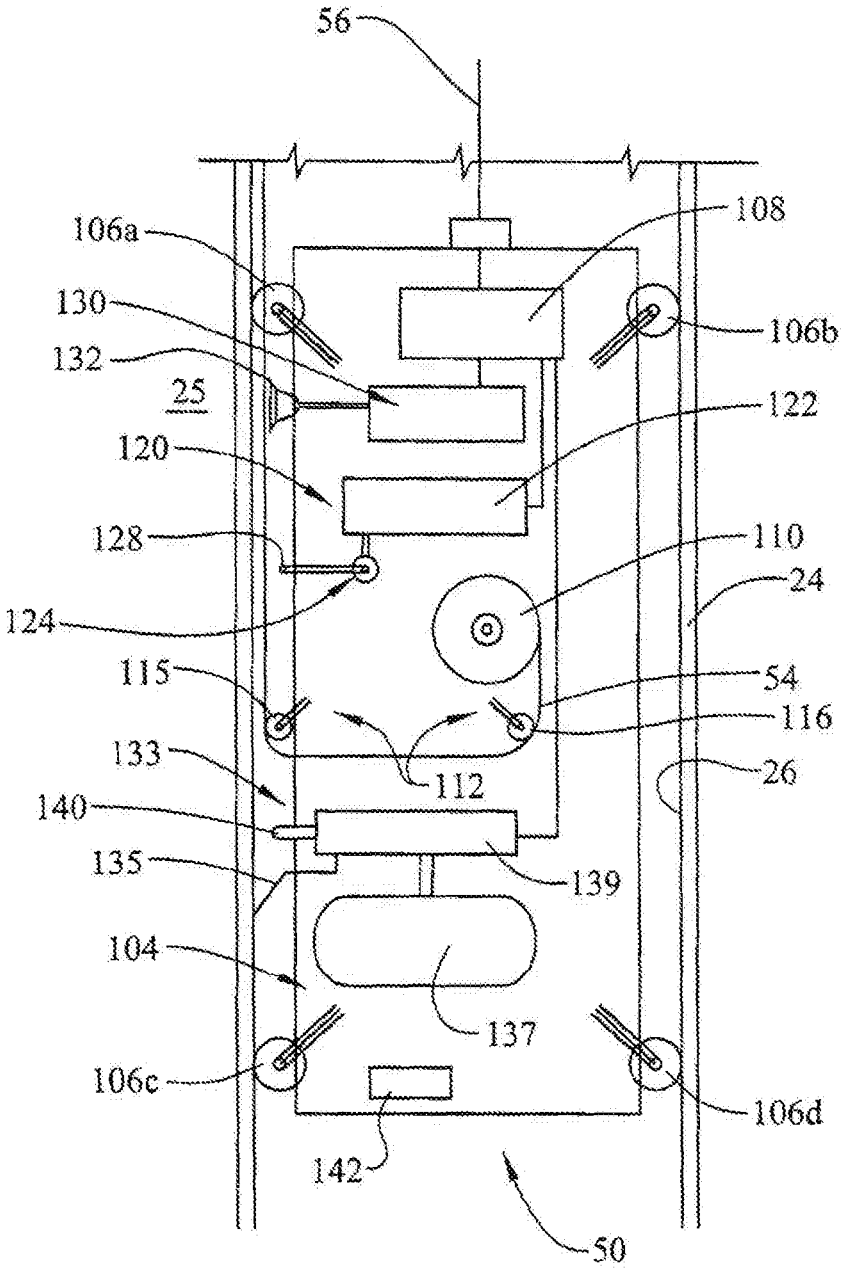
FIG. 6 depicts a tractor employed to configure subterranean components, in accordance with an aspect of an exemplary embodiment.

Reference will now follow to FIG. 6 in describing tractor 50 in accordance with an aspect of an exemplary embodiment. Tractor 50 includes a tractor body 104 supporting a plurality of wheels 106*a*-106*d* that are connected to a propulsion and control system 108. Tractor 50 supports a cable reel 110 and a cable guide system 112. Cable guide system 112 includes a first roller 115 and a second roller 116 that direct replacement cable 54 from cable reel 110 towards inner surface 26 of tubular string 24.

In addition to cable deployment, tractor 50 may also include systems for attaching replacement cable 54 to inner surface 26. In an embodiment, tractor 50 includes an adhesive deployment system 120 including an adhesive reservoir 122 and an adhesive deployment device 124 that may take the form of a spray nozzle 128. Adhesive deployment system 120 may employ a variety of adhesives that may include light curing or UV curing adhesives, heat curing adhesives and the like.

Thus, in an embodiment, adhesive deployment system 120 may also include an adhesive curing system 130 that may direct a curing energy toward inner surface 26. The curing energy may take the form of light source 132 that may focus on a ultra-violet end of a light spectrum, heat or other energy that could cause adhesive to set.

Tractor 50 may also include a cleaning system 133 that may prepare inner surface 26 for attachment of replacement cable 54. Cleaning system 133 may include a scraper 135 that is directed against inner surface 26. Cleaning system 133 may also include a cleaning fluid reservoir 137 having a cleaning fluid dispenser 139. Cleaning fluid dispenser 139 directs a cleaning fluid (not shown) through an outlet 140 that may take on various forms, onto inner surface 26.

Figure 7:
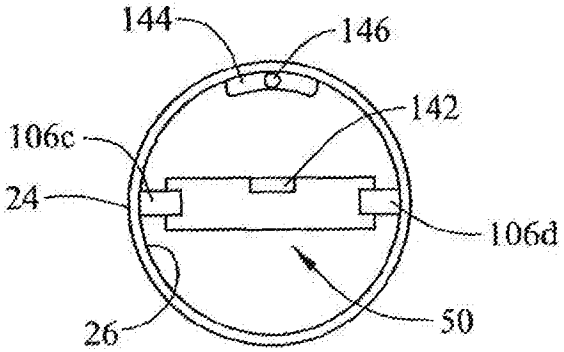
FIG. 7 depicts a top view of the tractor of FIG. 6 at a subterranean component, in accordance with an aspect of an exemplary embodiment.

In an embodiment, tractor 50 may also include a sensor 142 that may detect and/or communicate with address devices such as indicted at 144 in FIG. 7, located along inner surface 26 of tubular string 24. Each address device 144 may include a communication device 146 that could take the form of an RFID chip or the like that can provide information to sensor 142. The information could include details of a location of address device 144 such as adjacent a particular one of connector systems 30, details about components, location of stored components and the like.

Figure 8:
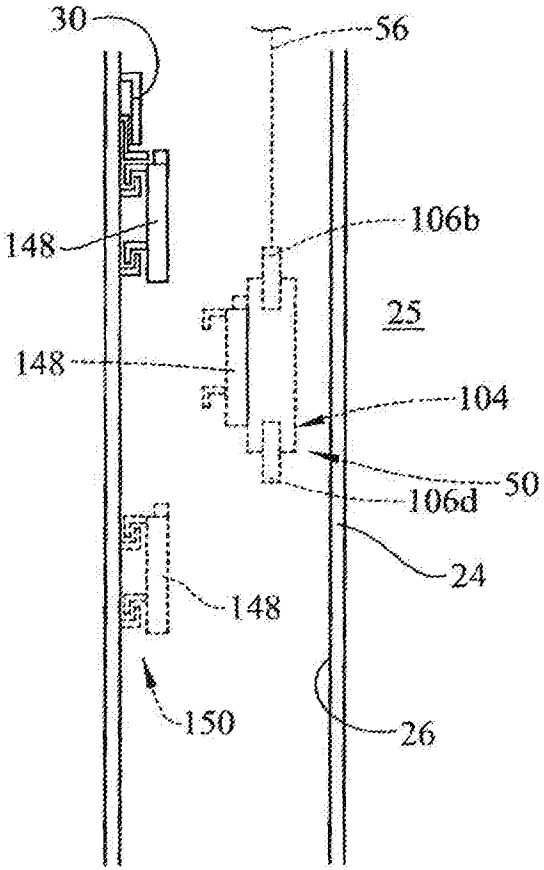
FIG. 8 depicts the tractor of FIG. 6 configuring a subterranean component, in accordance with an aspect of an exemplary embodiment.

In an embodiment, tractor 50 may be dispatched into tubular string 24 to move, configure, reconfigure or the like a sensor element such as indicated at 148 in FIG. 8. Tractor 50 may be guided into tubular string 24 to a parking element 150 that may support sensor element 148. Sensor element 148 may be deployed when tubular string 24 is run into the wellbore formed in formation 25. That is parking element 150 may define an element storage zone (not separately labeled) that holds a elements, such as sensor element 148, for later use. Alternatively, sensor element 148 may be carried into tubular string 24 and parked on parking element 150, or sensor element 148 may be temporarily positioned on parking element 150 while changes are being made to connection system 30.

Figure 9:
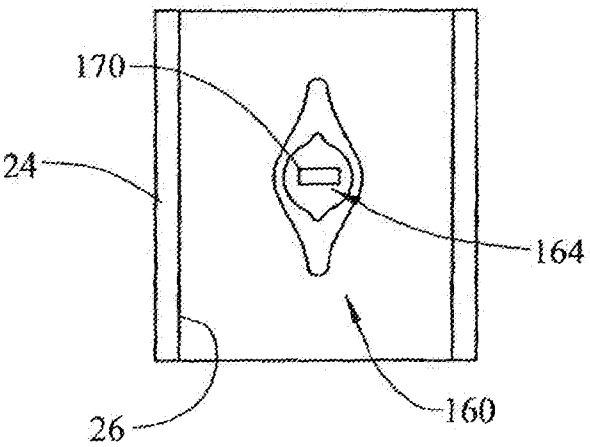
FIG. 9 depicts a guide member of the resource exploration and recovery system, of FIG. 1, in accordance with an aspect of an exemplary embodiment.

In an embodiment, one or more guide members 160 may be arranged on inner surface 26 of tubular string 24 such as shown in FIG. 9. Guide members 160 may be positioned on one side, another, or both and axially spaced from each connector system 30, parking element 150 or the like. Guide members 160 are arranged and positioned to ensure that tractor 50 does not run into, over, or have a negative contact with on any one of connector systems 30, parking elements 150 and the like.

Figure 10:
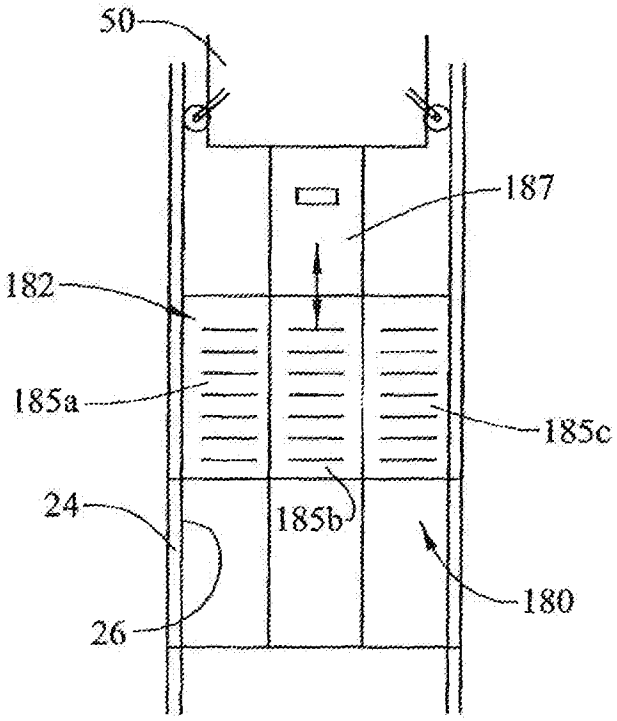
FIG. 10 depicts a screen system being configured by the tractor of FIG. 6, in accordance with an aspect of an exemplary embodiment.

In an embodiment, each guide members 160 may include a communication element 164, such as an RFID element 170 that may communicate with sensor 142 in tractor 50. Communication element 164 could, for example, provide feedback to operators pertaining to a position of tractor 50 in tubular string 24. In accordance with an exemplary aspect, RFID element 170 may identify a position of a connector system, a sensor, a valve, an actuator or a screen system such as shown at 180 in FIG. 10.

In an embodiment, tractor 50 may be deployed to screen system 180 arranged along tubular string 24. Screen system 180 includes a number of screen elements 182 including screen segments 185*a*-1.85*c* and flow blocking segments

187. Screen segments 185*a*-185*c* may allow flow to pass from and/or into tubular string 24. Flow blocking segments 187 prevent flow through one or more sections of screen system 180, In an embodiment, tractor 50 may be deployed into tubular string 24 to configure and/or reconfigure screen system 180. That is, tractor 50 may replace one or more screen segments with a flow blocking segments or vice versa depending on operating parameters.

At this point, it should be understood that the exemplary embodiments describe a system and method of configuring and/or reconfiguring wellbore components. The system may be employed to replace faulty components, update older components with newer, more modern versions, repair components, and make changes in components in order to continue operations without the need and associated costs of removing a tubular string from a wellbore.

Set forth below are some embodiments of the foregoing disclosure:

Embodiment 1

A method for configuring a wellbore system comprising: guiding a tractor into a tubular string including an inner surface supporting more or more components to a select one of the plurality of components; deploying an element from the tractor into the tubular string; engaging the selected one of the plurality of components with the tractor; and changing a configuration of the selected one of the plurality of components with the element deployed from the tractor.

Embodiment 2

The method of any previous embodiment, further comprising: detecting a fault of the selected one of the plurality of components.

Embodiment 3

The method of any previous embodiment, wherein detecting the fault includes detecting an interruption in one of an electrical flow path, an optical flow path, and a hydraulic flow path to the select one of the plurality of components.

Embodiment 4

The method of any previous embodiment, wherein engaging the select one of the plurality of components includes transporting the element defining a cable to the selected one of the plurality of components with the tractor.

Embodiment 5

The method of any previous embodiment, wherein changing the configuration of the selected one of the plurality of components includes connecting the cable to the selected one of the plurality of components.

Embodiment 6

The method of any previous embodiment, wherein transporting the element includes transporting a cable comprising one of an electric cable, an optical cable, and a hydraulic cable from the surface system into the wellbore.

Embodiment 7

The method of any previous embodiment, further comprising: securing the cable to the inner surface.

Embodiment 8

The method of any previous embodiment, wherein securing the cable to the inner surface includes applying an adhesive to the cable and the inner surface.

Embodiment 9

The method of any previous embodiment, wherein engaging the select one of the plurality of components includes connecting the tractor to the selected one of the plurality of components.

Embodiment 10

The method of any previous embodiment, further comprising: transporting another element in the wellbore with the tractor; and parking the another element in the wellbore.

Embodiment 11

The method of any previous embodiment, further comprising: disengaging the selected one of the plurality of components from a first connection point; parking the selected one of the plurality of components in the wellbore; connecting the tractor with the another element; and installing the another element in the first connection point.

Embodiment 12

The method of any previous embodiment, wherein transporting the another element in the wellbore includes carrying the another element from a surface system into the wellbore.

Embodiment 13

The method of any previous embodiment, wherein transporting the another element in the wellbore includes capturing the another element from an element storage zone in the wellbore.

Embodiment 14

The method of any previous embodiment, wherein capturing the another element from the element storage zone includes sensing a signal associated a location of the element storage zone.

Embodiment 15

The method of any previous embodiment, wherein sensing the signal associated with the location of the element storage zone includes receiving data pertaining to the another element.

Embodiment 16

The method of any previous embodiment, wherein engaging the selected one of the plurality of components with the tractor includes connecting with a portion of a screen system.

Embodiment 17

The method of any previous embodiment, wherein connecting with the portion of the screen system includes removing the portion of the screen system.

Embodiment 18

The method of any previous embodiment, wherein removing the portion of the screen system includes replacing the portion of the screen system with the element deployed from the tractor.

Embodiment 19

The method of any previous embodiment, wherein replacing the portion of the screen system with the element deployed from the tractor includes installing a screen segment in the screen system.

Embodiment 20

The method of any previous embodiment, wherein replacing the portion of the screen system with the element deployed from the tractor includes installing a flow blocking segment in the screen system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for configuring a wellbore system comprising:

guiding a tractor into a tubular string including an inner surface to a selected one of a plurality of components supported on the inner surface;

deploying an element from the tractor into the tubular string;

engaging the selected one of the plurality of components with the tractor;

changing a configuration of the selected one of the plurality of components with the element deployed from the tractor; and detecting a fault of the selected one of the plurality of components by detecting an interruption in one of an electrical flow path, an optical flow path, and a hydraulic flow path to the select one of the plurality of components.

2. The method of claim 1, wherein engaging the selected one of the plurality of components includes transporting the element defining a cable to the selected one of the plurality of components with the tractor.

3. The method of claim 2, wherein changing the configuration of the selected one of the plurality of components includes connecting the cable to the selected one of the plurality of components.

4. The method of claim 2, wherein transporting the element includes transporting a cable comprising one of an electric cable, an optical cable, and a hydraulic cable from the surface system into the wellbore.

5. The method of claim 4, further comprising: securing the cable to the inner surface.

6. The method of claim 5, wherein securing the cable to the inner surface includes applying an adhesive to the cable and the inner surface.

7. A method for configuring a wellbore system comprising:

guiding a tractor into a tubular string including an inner surface to a selected one of a plurality of components supported on the inner surface;

deploying an element from the tractor into the tubular string;

engaging the selected one of the plurality of components with the tractor;

changing a configuration of the selected one of the plurality of components with the element deployed from the tractor;

transporting another element in the wellbore with the tractor;

parking the another element in the wellbore;

disengaging the selected one of the plurality of components from a first connection point;

parking the selected one of the plurality of components in the wellbore;

connecting the tractor with the another element; and installing the another element in the first connection point.

8. The method of claim 7, wherein transporting the another element in the wellbore includes carrying the another element from a surface system into the wellbore.

9. The method of claim 7, wherein transporting the another element in the wellbore includes capturing the another element from an element storage zone in the wellbore.

10. The method of claim 9, wherein capturing the another element from the element storage zone includes sensing a signal associated a location of the element storage zone.

11. The method of claim 10, wherein sensing the signal associated with the location of the element storage zone includes receiving data pertaining to the another element.

12. A method for configuring a wellbore system comprising:

guiding a tractor by driving a wheel operatively connected to an on-board propulsion and control system into a tubular string along an inner surface to a selected one of a plurality of components supported on the inner surface;

deploying an element from the tractor into the tubular string;

engaging the selected one of the plurality of components with the tractor by connecting with a portion of a screen system; and removing a portion of the screen system by replacing the portion of the screen system with the element deployed from the tractor.

13. The method of claim 12, wherein replacing the portion of the screen system with the element deployed from the tractor includes installing a screen segment in the screen system.

14. The method of claim 12, wherein replacing the portion of the screen system with the element deployed from the tractor includes installing a flow blocking segment in the screen system.

* * * * *